US006584964B1

(12) United States Patent
Seilenbinder et al.

(10) Patent No.: US 6,584,964 B1
(45) Date of Patent: Jul. 1, 2003

(54) ENGINE HAVING A CENTRIFUGAL OIL SEPARATOR

(75) Inventors: Richard Seilenbinder, Hales Corners, WI (US); Robert K. Mitchell, Pewaukee, WI (US)

(73) Assignee: Briggs & Stratton Corporation, Wauwatosa, WI (US)

( * ) Notice: Subject to any disclaimer, the term of this patent is extended or adjusted under 35 U.S.C. 154(b) by 0 days.

(21) Appl. No.: 10/217,395

(22) Filed: Aug. 13, 2002

(51) Int. Cl.[7] ..... F01M 1/00
(52) U.S. Cl. ..... 123/572
(58) Field of Search ..... 123/572, 573, 123/574, 41.86

(56) References Cited

U.S. PATENT DOCUMENTS 4,142,487 A 3/1979 Somraty
4,329,968 A * 5/1982 Ishikawa et al. ..... 123/573
4,651,704 A 3/1987 Sekiguchi
4,922,881 A 5/1990 Tamba et al.
5,542,402 A * 8/1996 Lee et al. ..... 123/572
5,954,035 A * 9/1999 Hofer et al. ..... 123/573
6,502,565 B2 1/2003 Schmid et al.

FOREIGN PATENT DOCUMENTS

JP 8177450 7/1996

* cited by examiner

*Primary Examiner*—Marguerite McMahon
(74) *Attorney, Agent, or Firm*—Michael Best & Friedrich LLP

(57) ABSTRACT

A breather and separator assembly for an engine. The engine includes a crankcase, a cylinder communicating with the crankcase, and a piston coupled for reciprocation in the cylinder. The engine includes a rotating shaft and a crankcase wall that includes a stationary aperture fluidly connected to an air/fuel induction system. The breather and separator assembly is separate from the shaft and adapted to be rotatable with the shaft. The breather and separator assembly includes a first side, an opposite second side, and an outer edge between the first and second sides. The first side is adapted to face the crankcase wall and has an annular groove adapted to be in fluid flow communication with the aperture during rotation of the rotating shaft. The breather and separator assembly also includes at least one radial passageway extending between the annular groove and the outer edge.

27 Claims, 3 Drawing Sheets

ENGINE HAVING A CENTRIFUGAL OIL SEPARATOR

FIELD OF THE INVENTION

The invention relates to engines, and more particularly, to engines having centrifugal oil separators.

BACKGROUND OF THE INVENTION

One disadvantage of using four-stroke internal combustion engines for outdoor power tools traditionally has been the inability to operate the engine upside down or at extreme angles that may be required by the operator. Oil in the crankcase in those instances would tend to drain through the engine block and into either the air/fuel induction system, the combustion chamber, or the carburetor, thereby upsetting otherwise efficient fuel combustion during operation.

SUMMARY OF THE INVENTION

The present invention is directed to an engine comprising a crankcase, a cylinder communicating with the crankcase, and a piston coupled for reciprocation in the cylinder. The piston reciprocates between a first position and a second position that is farther from the crankcase than the first position. Movement of the piston from the first position to the second position decreases a crankcase pressure and movement of the piston from the second position to the first position increases the crankcase pressure. The engine also includes a ventilator system and a rotating shaft within the crankcase. The ventilator system includes a stationary aperture in the crankcase and a separator rotatable with the shaft. The separator includes a first side, an opposite second side, and an outer edge between the first and second sides. The first side faces a crankcase wall and includes an annular groove in fluid flow communication with the aperture during rotation of the shaft. The separator also includes at least one radial passageway extending between the annular groove and the outer edge.

Another embodiment of the present invention is directed to a breather and separator assembly for an engine. The engine includes a crankcase, a cylinder communicating with the crankcase, and a piston coupled for reciprocation in the cylinder. The piston reciprocates between the first position and the second position that is farther from the crankcase than the first position. The engine includes a rotating shaft and a crankcase wall that includes a stationary aperture fluidly connected to an air/fuel induction system. The breather and separator assembly is separate from the shaft and adapted to be rotatable with the shaft. The breather and separator assembly includes a first side, an opposite second side, and an outer edge between the first and second sides. The first side is adapted to face the crankcase wall and has an annular groove adapted to be in fluid flow communication with the aperture during rotation of the rotating shaft. The breather and separator assembly also includes at least one radial passageway extending between the annular groove and the outer edge.

Other features and advantages of the invention will become apparent to those skilled in the art upon review of the following detailed description, claims, and drawings.

Figure 1:
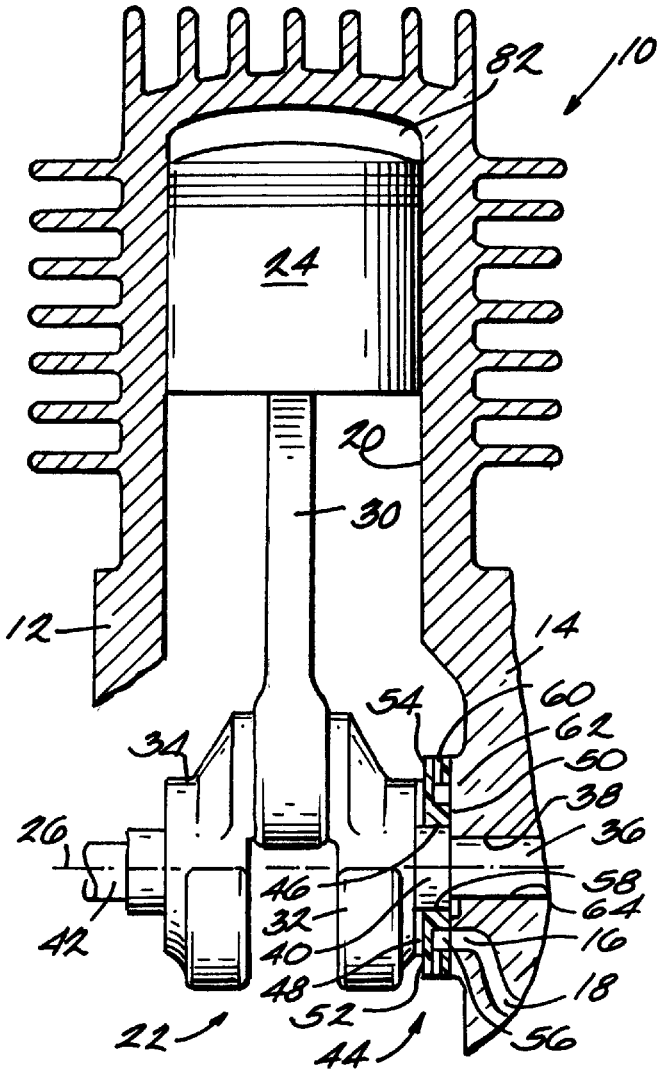
FIG. 1 is a schematic view of an engine having a breather and separator assembly embodying the invention.

Before one embodiment of the invention is explained in detail, it is to be understood that the invention is not limited in its application to the details of construction and the arrangements of the components set forth in the following description or illustrated in the drawings. The invention is capable of other embodiments and of being practiced or being carried out in various ways. Also, it is understood that the phraseology and terminology used herein is for the purpose of description and should not be regarded as limiting. The use of "including" and "comprising" and variations thereof herein is meant to encompass the items listed thereafter and equivalents thereof as well as additional items. The use of "consisting of" and variations thereof herein is meant to encompass only the items listed thereafter. The use of letters to identify elements of a method or process is simply for identification and is not meant to indicate that the elements should be performed in a particular order.

DETAILED DESCRIPTION

FIG. 1 schematically illustrates an engine 10 including a crankcase 12 having a crankcase wall 14. The crankcase wall 14 includes a stationary aperture 16 that is fluidly connected to an air/fuel induction system 18. The crankcase 12 includes a cylinder 20 communicating with the crankcase 12, and the engine 10 includes a crankshaft 22 and a piston 24. The crankshaft 22 is coupled for rotation within the crankcase 12 and about a crankshaft axis 26. The piston 24 is received within the cylinder 20 and coupled to a crank pin 28 of the crankshaft 22 by a connecting rod 30 such that the crankshaft 22 is rotated by the piston 24 as the piston 24 reciprocates between a first position and a second position farther away from the crankcase 12 than the first position. The engine 10 also includes a rotating cam shaft (not shown) that is coupled for rotation with the crankshaft 22.

The crankshaft 22 includes a first counterweight 32 on one side of the crank pin 28 and a second counterweight 34 on the opposite side of the crank pin 28. The crankshaft 22 also includes a first end 36 supported for rotation by an aperture 38 in the crankcase wall 14 and an intermediate shaft portion 40 between the first end 36 and the first counterweight 32. A second end 42 opposite to the first end 36 is supported for rotation by the crankcase 12.

Figure 2:
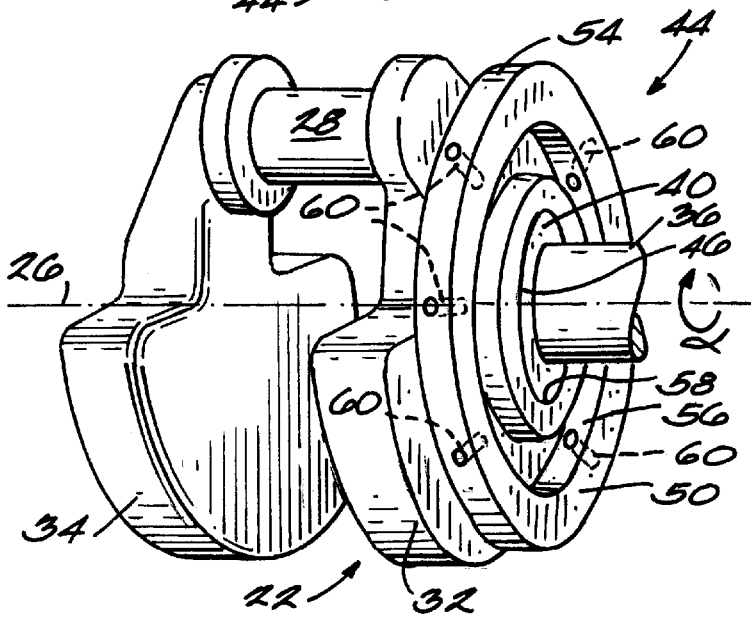
FIG. 2 is a perspective view of a portion of the breather and separator assembly of FIG. 1.

With further reference to FIG. 2, the engine 10 also includes a breather and separator assembly 44 that is coupled to the crankshaft 22 for rotation with the crankshaft 22 about the axis 26. The assembly 44 is separate from the crankshaft 22 and is attached to the crankshaft 22 by inserting the intermediate shaft portion 40 through a central aperture 46 of the assembly 44 such that the assembly 44 is located between the first counterweight 32 and the crankcase wall 14. The assembly 44 is pressed onto the intermediate shaft portion 40 such that the assembly 44 rotates with the crankshaft 22. Alternatively, a pin (not shown) can be inserted into aligned holes (not shown) in the assembly 44 and the counterweight 32. An optional wave spring 48 is positioned between the first counterweight 32 and the assembly 44 to bias the assembly 44 against the crankshaft wall 14. The assembly 44 can be machined or molded from nylon or similar material.

The assembly 44 includes a first side 50 that faces the crankcase wall 14, an opposite second side 52 that faces the first counterweight 32, and an outer edge 54 between the first and second sides 50, 52. The first side 50 includes an annular groove 56 that encircles the aperture 46 and defines an arc a of three hundred sixty degrees. The annular groove 56 is located approximately midway between an inner edge 58 of the assembly 44 and the outer edge 54. More specifically, the annular groove 56 is positioned a distance away from the crankshaft axis 26 equal to the distance that the aperture 16 is positioned away from the crankshaft axis 26 such that the annular groove 56 fluidly communicates with the aperture 16 during rotation of the crankshaft 22. The assembly 44 also includes six radial passageways 60 that extend between the annular groove 56 and the outer edge 54. Each of the six radial passageways 60 is surrounded by a respective wall and has a diameter of 0.125 inches. A different number of radial passageways or a different passageway diameter, could be used. Although the illustrated assembly is shown as a disc, the assembly 44 can have other shapes.

Figure 3:
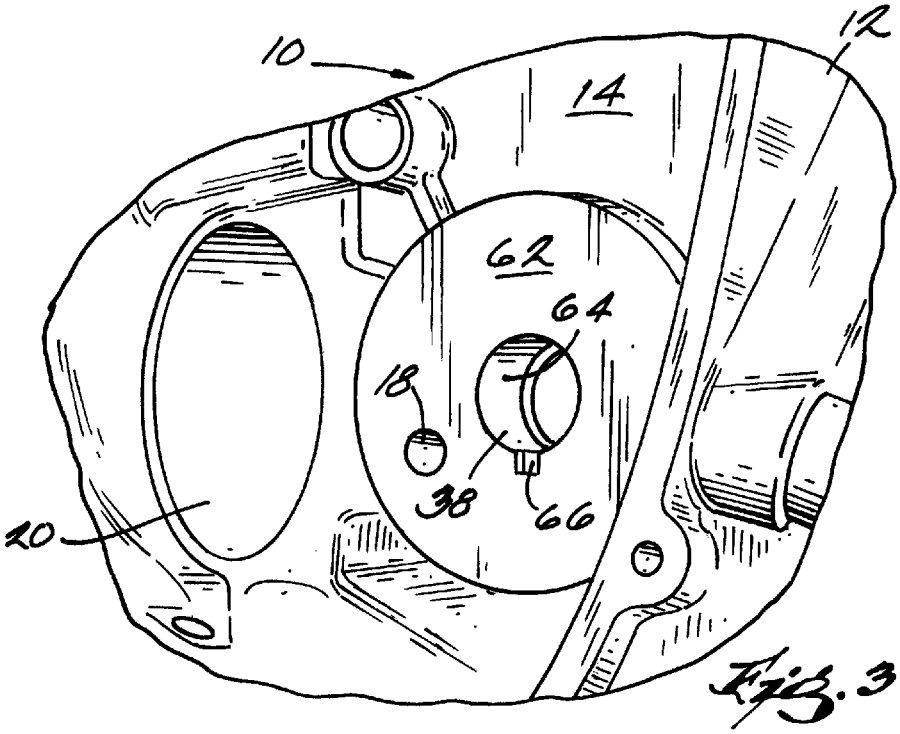
FIG. 3 is a perspective view of a portion of a crankcase of the engine shown in FIG. 1.

FIG. 3 illustrates a portion of the crankcase 12 and the crankcase wall 14. The crankcase wall 14 includes a substantially planar portion 62 that is positioned inwardly of the crankcase 12. The aperture 38 is centrally located in the crankcase wall 14 and includes a bearing surface 64. The bearing surface 64 is lubricated by routing lubricant from a passageway (not shown) in the crankcase wall 14 to the bearing surface 64. During operation, excess lubricant moves out of the aperture 38 toward the assembly 44 and out through a radially extending groove 66 in the crankcase wall 14. The groove 66 directs the lubricant between the crankcase wall 14 and the assembly 44 such that rotation of the assembly 44 directs the lubricant radially outwardly into the crankcase 12. The crankcase wall 14 is integrally cast with the crankcase 12 and machined or ground to form the planar portion 62 that contacts the first side 50 of the assembly 44.

Figure 5:
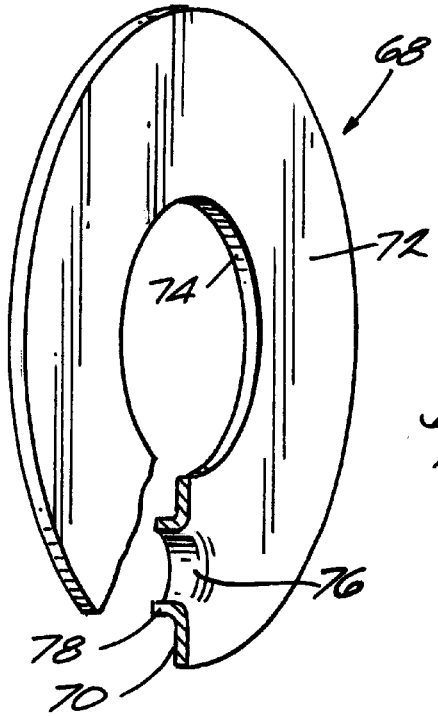
FIG. 5 is a partial cut-away view of a plate according to another embodiment of the invention.
Figure 6:
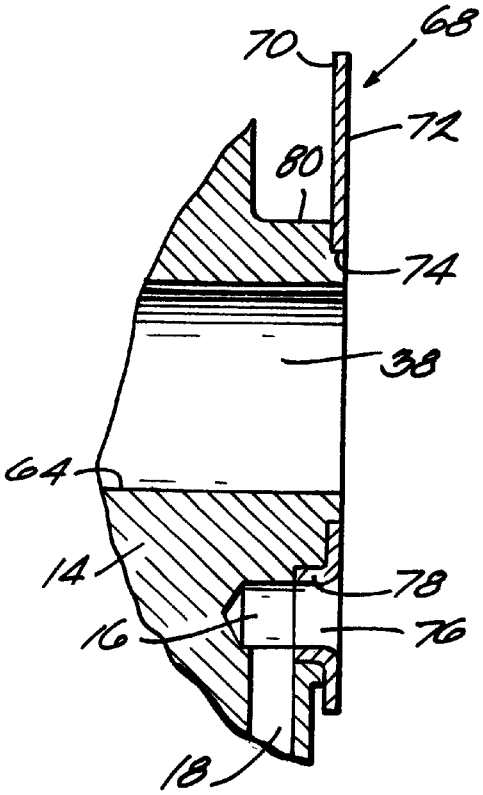
FIG. 6 is a cross-section view of the plate shown in FIG. 5.

In the alternative embodiment illustrated in FIG. 5, a stamped plate 68 can be connected to the crankcase 12 to substitute for the integrally-cast planar portion 62. The plate 68 can be used to retrofit crankcases 12 made with existing tooling or can be used to reduce the overall weight of the engine 10. The plate 68 includes a first side 70, a second side 72, a central aperture 74, and an aperture 76 that is surrounded by a flange 78. As shown in FIG. 6, the plate 68 is assembled to the crankcase 12 by inserting a hub portion 80 of the crankcase 12 into the central aperture 74 such that the first side 70 is facing the crankcase 12 and the second side 72 is facing the assembly 44. The flange 78 is inserted partially into the air/fuel induction passageway 18. The plate 68 can be welded into position or, alternatively, can be left unsecured because the assembly 44 will maintain the plate 68 in position. Specifically, the flange 78 will prevent the plate 68 from rotating and the optional wave spring 48 will bias the first side 50 of the assembly 44 against the second side 72 of the plate 68, thereby forcing the plate 68 against the crankcase 12.

During operation of the engine 10 and the assembly 44, controlled explosions in a combustion chamber 82 defined by the cylinder 20 reciprocate the piston 24 within the cylinder 20 thereby rotating the crankshaft 22. Rotation of the crankshaft 22 causes the counterweights 32, 34 to splash lubricant from the bottom of the crankcase 12 to create an air/lubricant mixture that is dispersed throughout the crankcase 12. Likewise, if the engine 10 is used in an outdoor power tool, the engine 10 may be rotated to various angles which will disperse the lubricant throughout the crankcase 12.

Movement of the piston 24 from the first position to the second position decreases a crankshaft pressure and movement of the piston 24 from the second position to the first position increases the crankcase pressure. Typically, when the crankcase pressure increases within the crankcase 12, air is released through a check valve breather system (not shown) into the air/fuel induction system 18. The purpose of the valve is to allow the air to move out of the crankcase 12 when the pressure within the crankcase 12 is higher than the ambient pressure and to deter air from the environment from entering the crankcase 12 when the crankcase pressure is lower than the ambient pressure. However, these systems are inadequate when the crankcase 12 is filled with an air/lubricant mixture which cannot be routed through the air/fuel induction system 18. More specifically, the air/lubricant mixture cannot be routed into the air/fuel induction system 18 because the air/lubricant mixture would increase fuel emissions, would foul the air cleaner, and would cause inefficient operation of the engine 10.

These shortcomings of the typical breather system are overcome by adding the assembly 44 of the present invention which separates the air and lubricant prior to releasing the air through the breather system downstream of the air/fuel induction passageway 18. As the assembly 44 rotates with the crankshaft 22, air from the air/lubricant mixture is allowed to enter the annular groove 56 through the radial passageways 60 of the rotating assembly 44 while lubricant from the air/lubricant mixture is redirected back into the crankcase 12. More specifically, as the assembly 44 rotates with the crankshaft 22, centrifugal forces drive droplets of lubricant radially outwardly from the radial passageways 60 of the rotating assembly 44 back into the crankcase 12. The air from the air/lubricant mixture enters the annular groove 56 and moves through the aperture 16 and into the air/fuel induction system 18.

It should be noted that the assembly 44 is not required to be connected to the crankshaft 22, but instead could be connected to other rotating shafts within the crankcase 22. For example, the assembly 44 could be mounted for rotation with a cam shaft. The assembly 44 would operate in the same manner as described above with respect to the crankshaft 22 except that the cam shaft typically rotates at one-half the speed of the crankshaft 22.

Figure 4:
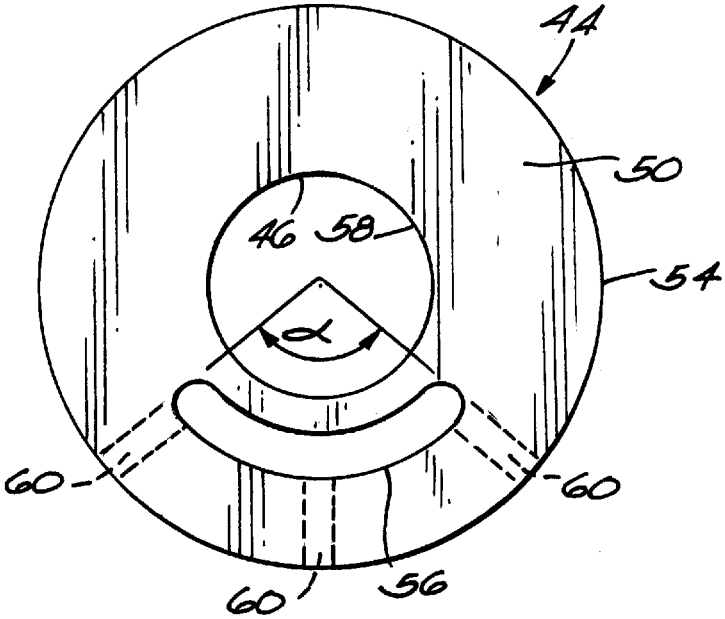
FIG. 4 is a side view of an alternate embodiment of a breather and separator assembly.

FIG. 4 illustrates another embodiment of the breather and separator assembly 44 having an annular groove 56 that defines an arc $\alpha$ of between approximately thirty and ninety degrees. Preferably, the arc $\alpha$ is approximately ninety degrees. In this embodiment, the assembly 44 includes three radial passageways 60 that extend between the annular groove 56 and the outer edge 54. Each of the three radial passageways 60 is surrounded by a respective wall and has a diameter of 0.125 inches. The term "annular groove," as used throughout the specification and claims, is used to identify a groove that defines an arc $\alpha$ between thirty and three hundred and sixty degrees.

The annular groove 56 illustrated in FIG. 4, eliminates the need for a reed or other check valve in the air/fuel passageway 18. The orientation of the annular groove 56 with respect to the crankshaft 22 allows the assembly 44 to operate as a rotary valve by providing intermittent communication between the annular groove 56 and the aperture 16 to thereby maintain an average vacuum in the crankcase 12. The assembly 44 is positioned such that the aperture 16 is blocked by the first side 50 as the piston 24 moves from the first position to the second position thereby decreasing the crankcase pressure. The aperture 16 then communicates with the annular groove 56 as the piston 24 moves from the second position to the first position which causes the crankcase pressure to increase. As the annular groove 56 communicates with the aperture 16, the air/lubricant mixture enters the radial passageways 60, and the assembly 44 separates the lubricant from the air. The lubricant is discharged back into the crankcase 12, and the air moves into the annular groove 56, through the aperture 16, and into the air/fuel passageway 18.

We claim:

1. An engine comprising:

a crankcase having a crankcase wall, and having a crankcase pressure in the crankcase;

a cylinder communicating with the crankcase;

a piston coupled for reciprocation in the cylinder between a first position and a second position farther from the crankcase than the first position, wherein movement of the piston from the first position to the second position decreases the crankcase pressure and movement of the piston from the second position to the first position increases the crankcase pressure;

a rotating shaft within the crankcase;

a ventilator system including:

a stationary aperture in the crankcase, and a separator rotatable with the shaft, the separator having a first side that faces the crankcase wall, the first side including an annular groove in fluid flow communication with the aperture during rotation of the shaft, an opposite second side, an outer edge between the first and second sides, and at least one radial passageway in the separator between the annular groove and the outer edge.

2. The engine of claim 1, wherein the separator includes a radially inward section adjacent to the rotating shaft, the annular groove located between the radially inward section and the outer edge.

3. The engine of claim 1, wherein the at least one radial passageway is surrounded by a wall.

4. The engine of claim 3, wherein the at least one radial passageway includes a diameter of approximately 0.125 inches.

5. The engine of claim 1, wherein the annular groove is a partial annular groove that is at least intermittently in fluid flow communication with the aperture during rotation of the rotating shaft, the partial annular groove defining an arc of between approximately thirty and ninety degrees.

6. The engine of claim 5, wherein the partial annular groove defines an arc length of approximately ninety degrees.

7. The engine of claim 1, wherein the at least one radial passageway includes at least three spaced radial passageways extending in the separator between the annular groove and the outer edge, each of the at least three radial passageways surrounded by a respective wall.

8. The engine of claim 1, wherein the annular groove defines an arc of three hundred sixty degrees.

9. The engine of claim 1, wherein the rotating shaft is a crankshaft.

10. The engine of claim 9, wherein the crankshaft includes a counterweight, and wherein the second side faces the counterweight.

11. The engine of claim 10, further comprising a spring between the counterweight and the second side.

12. The engine of claim 1, further comprising an air/fuel induction system, the aperture being fluidly connected to the air/fuel induction system.

13. The engine of claim 1, wherein the aperture is located in a plate disposed between the crankcase wall and the separator.

14. The engine of claim 13, wherein the plate includes a flange extending from the plate and around the aperture.

15. The engine of claim 1, wherein the crankcase wall includes a bearing at least partially supporting the crankshaft for rotation, the bearing including radially extending groove opening toward the first side.

16. A breather and separator assembly for an engine including a crankcase having a crankcase wall, and having a crankcase pressure within the crankcase, the crankcase wall having a stationary aperture fluidly connected to an air/fuel induction system, a cylinder communicating with the crankcase, a piston coupled for reciprocation in the cylinder between a first position and a second position farther from the crankcase than the first position, wherein movement of the piston from the first position to the second position decreases the crankcase pressure and movement of the piston from the second position to the first position increases the crankcase pressure, and a rotating shaft within the crankcase, the breather and separator assembly separate from the shaft and adapted to be rotatable with the shaft, the breather and separator assembly comprising:

a first side adapted to face the crankcase wall, the first side having an annular groove adapted to be in fluid flow communication with the aperture during rotation of the rotating shaft, and an opposite second side, an outer edge between the first and second sides, and at least one radial passageway extending in the separator between the annular groove and the outer edge.

17. The breather and separator assembly of claim 16, wherein the separator includes a radially inward section adapted to be adjacent to the rotating shaft, the annular groove located between the radially inward section and the outer edge.

18. The breather and separator assembly of claim 16, wherein the at least one radial passageway is surrounded by a wall.

19. The breather and separator assembly of claim 18, wherein the at least one radial passageway includes a diameter of approximately 0.125 inches.

20. The breather and separator assembly of claim 16, wherein the annular groove is a partial annular groove that is adapted to be at least intermittently in fluid flow communication with the aperture during rotation of the rotating shaft, the partial annular groove defining an arc of between approximately thirty and ninety degrees.

21. The breather and separator assembly of claim 20, wherein the partial annular groove defines an arc of approximately ninety degrees.

22. The breather and separator assembly of claim 16, wherein the at least one radial passageway includes at least three spaced radial passageways extending in the separator between the annular groove and the outer edge, each of the at least three radial passageways surrounded by a respective wall.

23. The breather and separator assembly of claim 16, wherein the annular groove defines an arc of three hundred sixty degrees.

24. The breather and separator assembly of claim 16, wherein the rotating shaft is a crankshaft including a counterweight, and wherein the second side is adapted to face the counterweight.

25. The breather and separator assembly of claim 24, further comprising a spring adapted to be positioned between the counterweight and the second side.

26. The breather and separator assembly of claim 16, wherein the aperture is located in a plate adapted to be disposed between the crankcase wall and the separator.

27. The breather and separator assembly of claim 26, wherein the plate includes flange extending from the plate and around the aperture.

* * * * *